US005673434A

United States Patent [19]

Risk

[11] Patent Number: 5,673,434

[45] Date of Patent: Oct. 7, 1997

[54] NECKTIE FABRICATED FROM A PLURALITY OF RIGID COMPONENTS

[75] Inventor: James J. Risk, Boone, N.C.

[73] Assignee: Risk Design, Inc., Boone, N.C.

[21] Appl. No.: 443,659

[22] Filed: Jun. 1, 1995

[51] Int. Cl.[6] ..... A41D 27/00

[52] U.S. Cl. ..... 2/144; 2/148; 2/149; 2/150

[58] Field of Search ..... 2/144, 145, 146, 2/148, 149, 150, 151, 153, 154, 155, 156, 157, 152.1; 434/159, 406; 446/26, 27, 28

[56] References Cited

U.S. PATENT DOCUMENTS

| | | | |
|---|---|---|---|
| 2,692,387 | 10/1954 | Spaniol | 2/144 |
| 4,546,494 | 10/1985 | Garber | 2/144 |
| 4,627,113 | 12/1986 | Lord | 2/144 |
| 5,036,550 | 8/1991 | Wilsey | 2/144 |

FOREIGN PATENT DOCUMENTS

| | | | |
|---|---|---|---|
| 672398 | 11/1989 | Switzerland | 2/144 |
| 8806414 | 9/1988 | WIPO | 2/144 |

OTHER PUBLICATIONS

Wireless, Minnesota Public Radio, 274, Filmore Ave East, St. Paul Minnesota.

*Primary Examiner*—Jeanette E. Chapman
*Attorney, Agent, or Firm*—Rhodes, Coats & Bennett, L.L.P.

[57] ABSTRACT

A solid necktie including a rounded coupling segment which has apertures extending therethrough. Also included are a plurality of supplemental segments. Each supplemental segment has a pair of apertures which extend therethrough and positioned as continuations of the apertures of the coupling segment wherein the apertures of the supplemental segments are in communication with the apertures of the coupling segment. Further included is an elastic cord material which has a central section positionable around the neck of a wearer and with portions thereof extending first through apertures of the coupling segment and then through apertures of the supplement segments for holding the segments in a generally planar orientation when worn.

7 Claims, 3 Drawing Sheets

NECKTIE FABRICATED FROM A PLURALITY OF RIGID COMPONENTS

BACKGROUND OF THE INVENTION

1. Field of the Invention

The present invention relates generally to neckties and, more particularly, to neckties, whether of a four-in-hand type or of a bow-tie type, fabricated of a plurality of rigid components, preferably wood, coupled together by elastic cord with the coupling cord positionable around the wearer's neck for support.

2. Description of the Prior Art

People wear items of apparel for warmth, modesty and adornment. One item of apparel commonly worn by men for adornment is the necktie. Necktie is normally a piece of fabric wrapped around the neck and then depending therefrom downwardly over the chest of the wearer. Such is a four-in-hand type necktie. Neckties may also be of a shorter length such as a bow-tie which is simply maintained essentially horizontal in the neck area of a wearer.

The adorning characteristic may take the form of a solid color tie of a same or contrasting color as the remainder of the wearer's apparel. It may also be provided with designs, writing and/or other indicia, again for adornment purposes or, in the alternative, for the statement of a message through the design or writing. Such message might be the advocating of a personal position of the wearer, support for an athletic team, an advertisement, or the like.

Neckties are normally made of a flexible cloth. A large number of other materials such as paper or wood are also used occasionally in the fabrication of ties for one purpose or another. Variations in materials, shapes, adornments and the like are all in an effort to improve ties or provide one type of benefit or the other.

As evidenced by a number of prior art patents, efforts are continuing to improve neckties, bow-ties as well as four-in-hand ties. For example, U.S. Pat. No. 4,546,494 to Garber, U.S. Pat. No. 4,627,113 to Lord and U.S. Pat. No. 5,036,550 to Wilsey disclose wooden ties formed of plural components. Also U.S. Pat. No. Des 318,754 to Hughes and U.S. Pat. No. Des. 320,499 to White relate to wooden ties. In addition, U.S. Pat. No. 2,578,269 to Sinton as well as U.S. Pat. No. Des. 166,115 to Melville and U.S. Pat. No. Des. 195,665 to Welch disclose bow-ties. Lastly, patents showing various other materials and designs are disclosed in U.S. Pat. No. 2,534,669 to Hall which discloses neckties, U.S. Pat. No. 2,692,387 to Spaniol which discloses a necktie with removable decorations, U.S. Pat. No. 3,003,153 to Laham a leather necktie, U.S. Pat. No. 5,084,916 to Austin which discloses a necktie assembly and U.S. Pat. No. 5,088,120 to Yen which discloses a combined and fixed necktie. Also of interest are U.S. Pat. Nos. Des. 277,627 to Chen, and 161,798 to Speilmann which disclose neckties.

As will become evident, nothing in the prior art provides the benefits and advantages attendant with the present invention.

SUMMARY OF THE INVENTION

The present invention is directed to a four-in-hand necktie comprising, in combination, a coupling segment formed of wood or other non-textile material in a flat configuration with a front face and a rear face and with a large curved upper edge and a short horizontal lower edge and with downwardly tapering linear side edges therebetween to form an essentially V-shaped configuration. The coupling Segment also have a pair of apertures extending therethrough from the upper edge to the lower edge. Each aperture is parallel with an associated side edge thereof. Further included are a plurality of supplemental segments. Each supplemental segment is fabricated of wood in a flat configuration with a front face and a rear face and V-shaped upper and lower edges in mating relationship with its next adjacent supplemental segment and with upwardly tapering side edges therebetween to form an essentially inverted V-shaped configuration. Each supplemental segment has a pair of linear apertures extending therethrough from the upper edge to the lower edge with each aperture being parallel with an adjacent associated side edge thereof. The apertures of the supplemental segments are correlated so that the apertures adjacent to each edge are in axial alignment with each other. The upper most extents of the apertures of the upper supplemental segment are in communication with the lowermost extents of the apertures of the coupling segment. The lowermost supplemental segment has a transverse termination aperture coupling its rear face and its adjacent linear aperture. Further included is an elastic cord positioned through the apertures of the coupling segment and supplement segments including the terminating aperture with an extended central portion of the elastic cord located on the side of the coupling segment remote from the supplemental segments used for positioning around the neck of a wearer.

Accordingly, it is an object of this invention to provide an improvement which overcomes the aforementioned inadequacies of the prior art devices and provides an improvement which is a significant contribution to the advancement of the art.

Another object of this invention is to construct ties of wooden segments coupled together by an elastic band which also holds the tie around the neck of its wearer.

Another object of this invention is to couple tie segments which may be readily used for the marking thereon indicia for any of a variety of purposes such as adornment, statements, advertising and the like.

A further object of the present invention is to generate a clattering sound by shaking the coupled wooden segments of a tie.

A further object of the present invention is to configure the segments of a wooden tie in mating S-shaped, V-shaped or any other such physically enabling configuration, hereinafter referred to as "V-shaped," so as to maintain its intended linear shape fulfilled by the application of forces upon any one or more of the segments.

An other object of the invention is to simplify the construction and use of wooden neckties.

Another object of this invention is to provide a necktie comprising a flat rigid coupling segment which has apertures extending therethrough. Also included are a plurality of supplemental segments. Each supplemental segment has a pair of apertures which extend therethrough and positioned as continuations of the apertures of the coupling segment wherein the apertures of the supplemental segments are in communication with the apertures of the coupling segment. Further included is an elastic cord material which has a central section positionable around the neck of a wearer and with portions thereof extending first through apertures of the coupling segment and then through apertures of the supplemental segments for holding the segments in a generally planar orientation when worn.

These and other aspects of the present invention will become apparent to those skilled in the art after a reading of the following description of the preferred embodiment when considered with the drawings.

DESCRIPTION OF THE PREFERRED EMBODIMENTS

Figure 2:
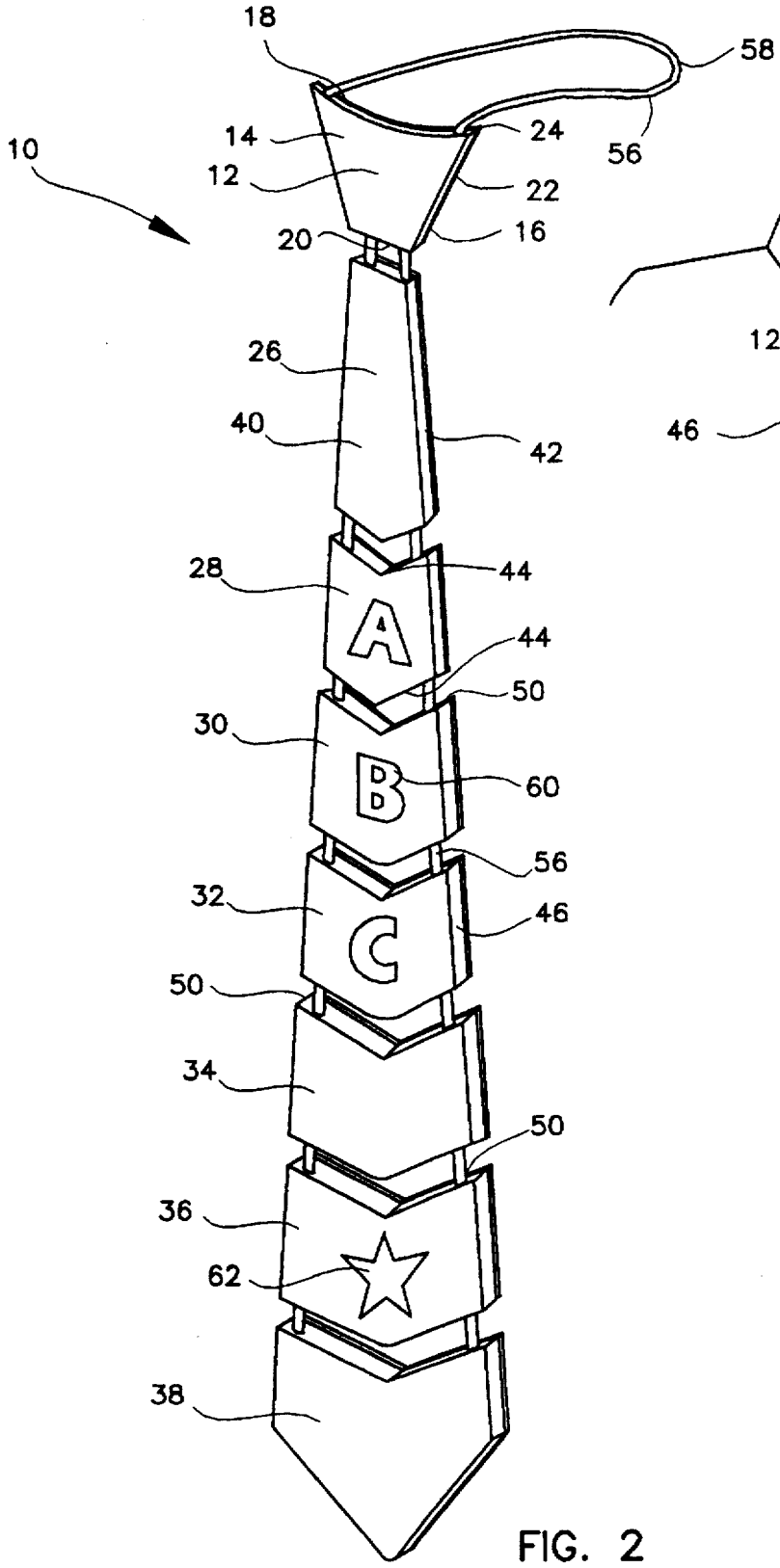
FIG. 2 is a perspective illustration of the tie shown in FIG. 1 but with the segments separated slightly to show certain constructions thereof.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
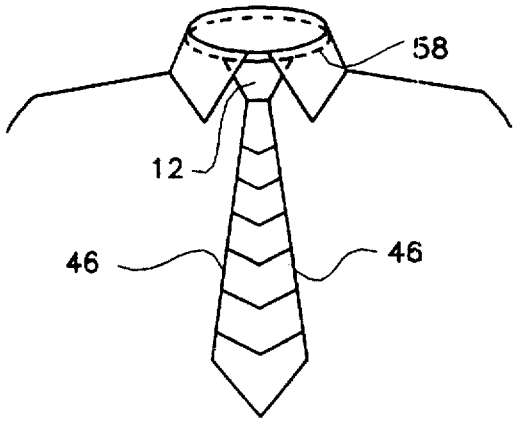
FIG. 1 is a front elevational view of the preferred embodiment of the new and improved wooden neckties constructed in accordance with the principles of the present invention.
Figure 3:
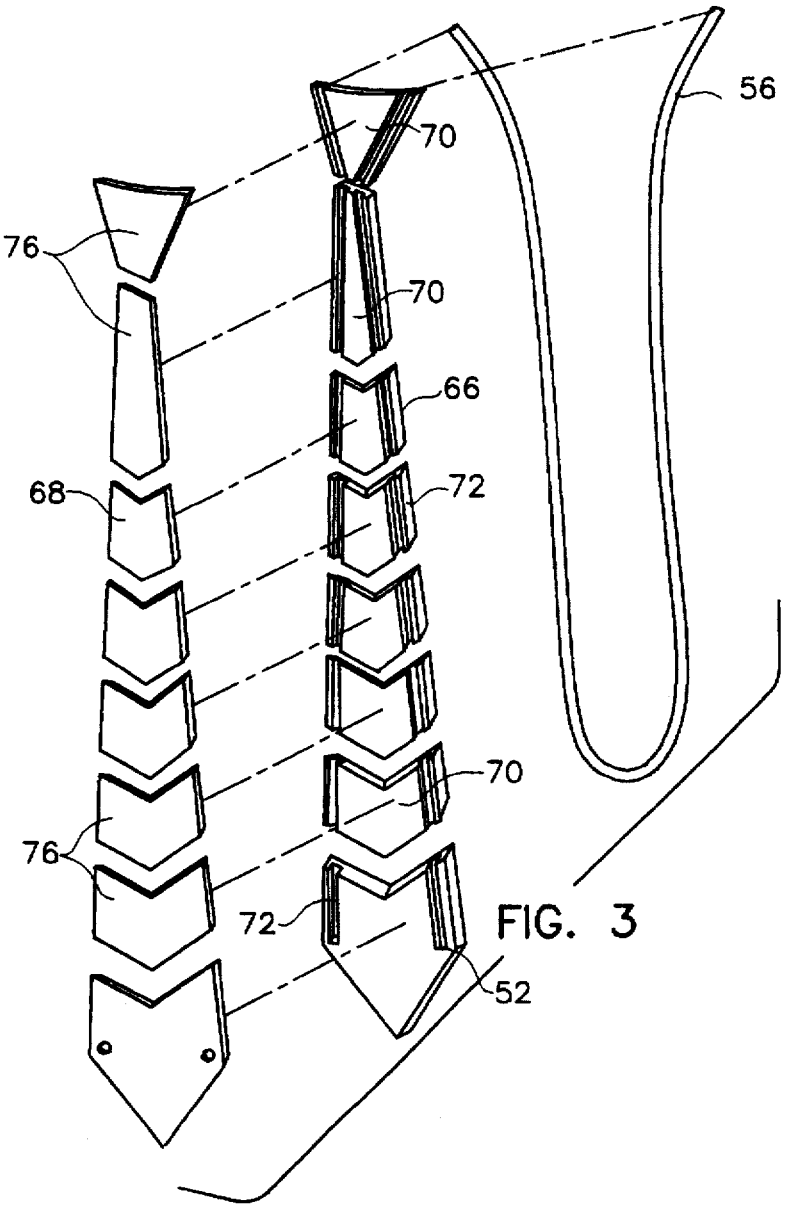
FIG. 3 is an exploded perspective view of the tie shown in FIGS. 1 and 2.
Figure 4:
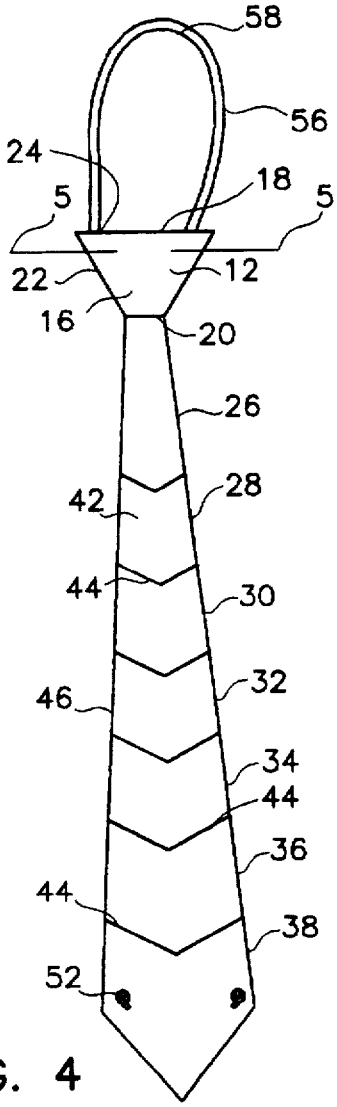
FIG. 4 is a back view of the tie shown in the prior Figures.
Figure 5:
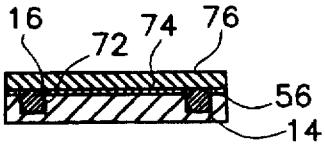
FIG. 5 is a sectional view taken along line 5—5 of FIG. 4.
Figure 6:
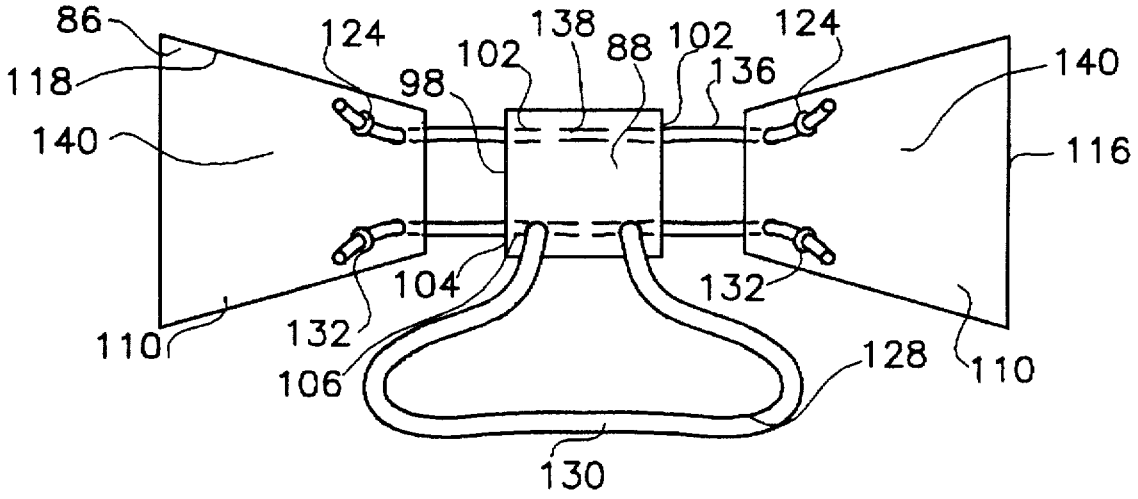
FIG. 6 is a rear elevational view of a bow-tie constructed in accordance with an alternate embodiment of the invention.
Figure 7:
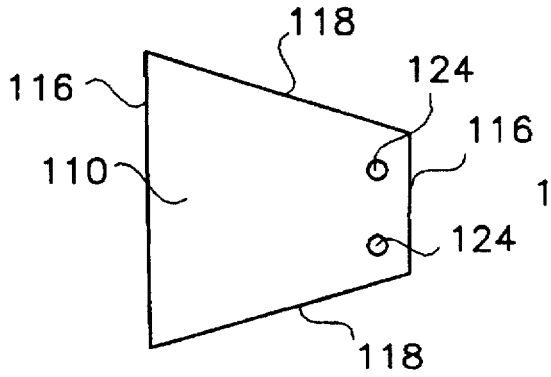
FIGS. 7 and 8 are rear and side elevational views of the supplemental segments of the bow-tie of FIG. 4.
Figure 8:
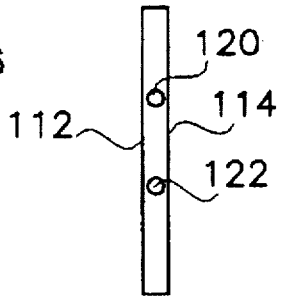
Figure 9:
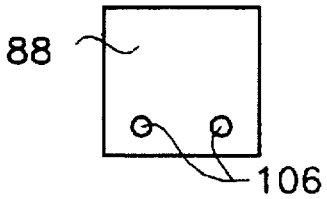
FIGS. 9 and 10 are rear and side elevational views of the coupling component of the bow-tie of FIG. 4.
Figure 10:
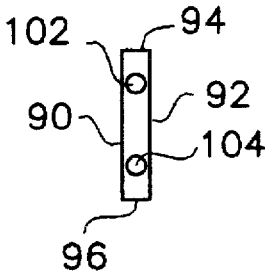

Referring now to the drawings in general and FIG. 1 in particular, it will be understood that the illustrations are for the purpose of describing a preferred embodiment of the invention and are not intended to limit the invention thereto. As best seen in FIG. 1, a new and improved wooden necktie embodying the principles and concepts of the present invention and generally designated by the reference numeral 10 is shown.

The present invention, the new and improved wooden or non-textile neckties, are comprised of a plurality of components. Such components in their broadest context include a coupling segment, a plurality of supplemental segments and an elastic cord. Such components are individually configured and correlated with respect to each other so as to attain the desired objective.

The central component of the system 10 of the present invention is a coupling segment 12. In the preferred embodiment as shown, for example, in FIG. 1, such coupling segment is formed preferably of wood or other rigid material of an aesthetically pleasing appearance. It has a front face 14 and a rear face 16. It also has a large curved upper edge 18 and a short horizontal lower edge 20. Downwardly tapering linear side edges 22 couple the upper and lower edges to form a V-shaped configuration. The coupling segment also has a pair of apertures 24 extending therethrough. Such apertures extend from the upper edge to the lower edge. Each aperture is parallel with an associated side edge of such coupling segment. In the most preferred embodiment, front face 14 is rounded or arched to more approximate the shape and appearance of a conventional fabric tie.

The next major components of the system 10 are a plurality of supplemental segments 26, 28, 30, 32, 34, 36 and 38. Each of the supplemental segments is fabricated of wood in a flat configuration. Each supplemental segment also has a front face 40 and a rear face 42. The supplemental segments are formed with V-shaped upper and lower edges 44 between each next adjacent supplemental segment. Such V-shaped upper and lower edges are in mating relationship with its next adjacent supplemental segment. Together the supplemental segments form upwardly tapering edges 46 therebetween. This forms an essentially inverted V-shaped configuration when coupled together for wearing.

Each supplemental segment has a pair of linear apertures 50. Such apertures extend through the supplemental segments from the upper edges to the lower edges adjacent to the side edges. Each aperture is parallel with an adjacent associated side edge. Together the apertures of the supplemental segments are correlated whereby the apertures adjacent to each edge are in axial alignment with each other. The lower most supplemental segment has a transverse termination aperture 52 coupling its rear face with its adjacent linear aperture. The upper most supplemental segment has its apertures, at its upper edge, in alignment with the apertures of the coupling segment, at its lower edge.

The final component of the system 10 is an elastic cord 56. The elastic cord is positioned through the apertures of the coupling segment and supplemental segments including the termination aperture. The elastic cord has an extended central portion 58 located on the side of the coupling segment remote from the supplemental segments. Such elastic cord is for positioning around the neck of the wearer during use. Note FIG. 1. When so positioned for use, the tie will give a distinctive appearance of high design and quality. It may be fabricated of a single color or contrasting color which may be correlated with the remainder of the apparel of the wearer. It may also be formed with indicia in the form of letters 60 or words. The indicia may also take the form of a design 62. The indicia is for the purpose of adornment, the statement of a message, advertising or the like.

The aesthetic appeal and fabrication simplicity are enhanced by constructing the segments of two mating components, a front component 66 and a veneer or rear component 68. The rear component is preferably fabricated of a first type wood. The front component is routed to form a region 70 with side edges 72. Adhered thereto as by an adhesive 74 is a rear component 76 of a matching size but of a contrasting color or grain. The mating edges are under cut to form therebetween at the interface the apertures for receiving the cord 56. However, in an alternative embodiment, the front and rear components 66,68 are mirror images of each other with complementary, mating grooves. Alternatively, the segments could be formed as one piece with drilled apertures or, if desired, the routed piece could be the rear component with the front component constructing the veneer. Further, the veneer or normally rear component need not always be of a contrasting color. This is new to the capability of employing colored stains. By properly staining the tie sections as well as components front and rear, a wide variety of matching or contrasting colors and/or patterns are possible.

The shape of the coupling segments is in the form of "V" or chevron-shaped areas of contact which will increase the frictional contact between segments. This promotes the retention of the tie in a natural vertical orientation during use more than was possible previously with prior segmented wooden ties. This is due to the increased frictional forces therebetween tending to hold the tie segments in the intended vertical orientation. Note is taken that the use of the hyphen shaped areas of contact are employed in the primary embodiment of the invention as shown in the Figures.

It should be realized, however, that other shapes such as curves, sawtooth configurations, S-shapes or any other type of such physically enabling configurations could be readily utilized and are referred to herein as being "V-shaped." V-shapes are to maintain the linear shape of the tie fulfilled by the application of forces upon any one or more of the segments.

It is also been found that the tie segments, coupled adjacent to each other as disclosed, allow the wearer to grasp one portion of the tie and shake it forwardly and rearwardly. When such is done, a rattling sound will emanate to increase the novelty aspects of such ties.

An alternate embodiment of the invention is shown in FIGS. 6 through 10. Such alternate design relates to a bow-tie 86. Such bow-tie has as its central component a coupling segment 88. Such coupling segment is formed of wood in a flat configuration. It has a front face 90 and a rear face 92. It also has parallel upper and lower edges 94 and 96. Parallel side edges 98 couple the upper and lower edges.

Formed in the coupling segment are a plurality of apertures. Such apertures include a transverse horizontal upper aperture 102 and supplemental apertures 104 all extending from the side edges. The supplemental apertures extend through transverse termination apertures 106 extending between the supplemental apertures and intermediate points on the rear face of the coupling segments.

The next major components of the bow-tie are a plurality of supplemental segments 110. Each supplemental segment is formed of wood in a flat configuration. Each has a front face 112 and a rear face 114 with parallel inner and outer edges 116. Also included are tapering upper and lower edges 118 therebetween. One supplemental segment is located on each side of the coupling segments. Each supplemental segment includes an upper aperture 120 and a lower aperture 122. The upper aperture 120 of each supplemental segment is in axial alignment with the upper aperture of the coupling segment. Each aperture of each supplemental segment includes a transverse termination aperture 124 extending between the associated aperture and the rear face of its associated supplemental segment. The upper and lower apertures of the supplemental segments are in communication with the upper and lower apertures of the coupling segments adjacent to the side edges thereof. The lower aperture 122 of each supplemental segment is in axial alignment with the lower aperture of the coupling segment and is parallel to the upper apertures in the supplemental and coupling segments.

Joining the coupling segments and supplemental segments is elastic cord material forming a plurality of elastic cords. Such elastic cords include a lower elastic cord 128 having a central section 130 positioned around the neck of a wearer as in the primary embodiment. Free ends 132 of the lower elastic cord extend through the termination and lower apertures of the coupling and supplemental segments and terminate adjacent to the rear faces of the supplemental segments.

Lastly, an upper elastic cord 136 is formed with a central section 138 positioned in the upper aperture of the coupling segment and extending into the supplemental segments. It has its free ends 140 tied adjacent to the rear faces of the supplemental segments.

Certain modifications and improvements will occur to those skilled in the art upon a reading of the foregoing description. By way of example, the tie could be formed of other lightweight, solid materials such as plastic, metal and fiberglass. Also, while a chevron interface has been shown, equivalent structures such as a "S" or "wave" cut should perform equally well. It should be understood that all such modifications and improvements have been deleted herein for the sake of conciseness and readability but are properly within the scope of the following claims.

I claim:

1. A four-in-hand necktie comprising:

(a) a coupling segment formed of wood in a flat configuration with a front face and a rear face and with a large curved upper edge and a short horizontal lower edge and with downwardly tapering linear side edges therebetween to form an essentially V-shaped configuration, the coupling segment also having a pair of apertures extending therethrough from the upper edge to the lower edge, each aperture being parallel with an associated side edge thereof;

(b) a plurality of supplemental segments, each supplemental segment being fabricated of wood in a flat configuration with a front face and a rear face and V-shaped upper and lower edges in mating relationship with its next adjacent supplemental segment and with upwardly tapering side edges therebetween to form an essentially V-shaped configuration thereby maintaining the tie in a natural vertical orientation during use, each supplemental segment having a pair of linear apertures extending therethrough from the upper edge to the lower edge with each aperture being parallel with an adjacent associated side edge thereof, the apertures of the supplemental segments being correlated so that the apertures adjacent to each edge are in axial alignment with each other, the upper most extents of the apertures of the upper supplemental segment being in communication with the lowermost extents of the apertures of the coupling segment, the lowermost supplemental segment having a transverse termination aperture coupling its rear face and its adjacent linear aperture; and (c) an elastic cord positioned through the apertures of the coupling segment and supplement segments including the terminating aperture with an extended central portion of the elastic cord located on the side of the coupling segment remote from the supplemental segments for positioning around the neck of a wearer.

2. The necktie as set forth in claim 1 wherein the necktie is in a four-in-hand configuration and wherein the elastic cord material is a single component.

3. The necktie as set forth in claim 1 and further including indicia on at least one of the segments.

4. The necktie as set forth in claim 1 wherein the segments are fabricated of wood.

5. The necktie as set forth in claim 1 wherein the segments are formed of two components, a front component with a routed central rear and a rear component adhered thereto with the apertures formed at the interface of the components.

6. A bow-tie comprising:

(a) a coupling segment formed of wood in a flat configuration with a front face and a rear face and with upper and lower parallel edges and parallel side edges therebetween and with apertures extending therethrough, the apertures including a transverse horizontal upper aperture and supplemental horizontal apertures extending from the side edges and transverse termination apertures extending between the supplemental apertures and intermediate points on the front face of the coupling segment;

(b) a plurality of supplemental segments, each supplemental segment being formed of wood in a flat configuration with a front face and a rear face and with parallel inner and outer edges and tapering upper and lower edges therebetween and with one supplemental segment on each side of the coupling segment, each supplement segment including an upper aperture and a lower aperture, the upper aperture of each supplement segment being in axial alignment with the upper aperture of the coupling segment and with the lower apertures of the supplemental segments being parallel and in axial alignment with the lower aperture of the coupling segment, each lower aperture of each supplemental segment including a transverse termination aperture extending between its associated aperture and the rear face of its associated supplemental segment, the upper and lower apertures of the supplemental segments being in communication with the upper and lower apertures of the coupling segment adjacent to the side edges thereof;

(c) a lower elastic cord having a central section positioned around the neck of a wearer with free ends extending through the termination and lower apertures of the coupling and supplemental segments and terminating adjacent to the rear faces of the supplemental segments; and (d) an upper elastic cord having a central section positioned in the upper apertures of the coupling segment and extending trough the aperture of the supplemental segments and having its free ends tied adjacent to the rear face of the supplemental segments.

7. A method for forming a necktie formed from a solid material, said method comprising the steps of:

(a) forming a coupling segment from an elongate piece of solid material in a flat configuration with a rounded front face and a rear face and with a large curved upper edge and a short horizontal lower edge and with downwardly tapering linear side edges therebetween to form an essentially V-shaped configuration;

(b) shaping the remainder of the elongated solid piece into a tie-shape front piece;

(c) forming a pair of grooves extending therethrough from the upper edge to the lower edge, each groove being parallel with an associated side edge thereof;

(d) attaching a complementary rear face to said tie-shaped front piece to form a pair of apertures extending therethrough from the upper edge to the lower edge, each aperture being parallel with an associated side edge thereof;

(e) cutting combined front and rear face tie shaped piece to form a plurality of supplemental segments, each supplemental segment being fabricated of solid material in a flat configuration with a front face and a rear face and V-shaped upper and lower edges in mating relationship with its next adjacent supplemental segment and with upwardly tapering side edges therebetween to form an essentially V-shaped configuration thereby maintaining the tie in a natural vertical orientation during use, each supplemental segment having a pair of linear apertures extending therethrough from the upper edge to the lower edge with each aperture being parallel with an adjacent associated side edge thereof, the apertures of the supplemental segments being correlated so that the apertures adjacent to each edge are in axial alignment with each other, the upper most extents of the apertures of the upper supplemental segment being in communication with the lowermost extents of the apertures of the coupling segment, the lowermost supplemental segment having a transverse termination aperture coupling its rear face and its adjacent linear aperture; and (f) positioning an elastic cord through the apertures of the coupling segment and supplement segments including the terminating aperture with an extended central portion of the elastic cord located on the side of the coupling segment remote from the supplemental segments for positioning around the neck of a wearer.

* * * * *